US006079350A

United States Patent [19]

Parker

[11] Patent Number: 6,079,350

[45] Date of Patent: Jun. 27, 2000

[54] DEVICE FOR ATTRACTING ATTENTION—(TAXI HAILER)

[76] Inventor: George Parker, 3758 10th Ave., Apt. 10-B, New York, N.Y. 10034

[21] Appl. No.: 09/129,437

[22] Filed: Aug. 5, 1998

[51] Int. Cl.[7] ..... G09F 17/00

[52] U.S. Cl. ..... 116/173; 40/218

[58] Field of Search ..... 428/98; 116/173; 40/218

[56] References Cited

U.S. PATENT DOCUMENTS

| | | | |
|---|---|---|---|
| 4,574,726 | 3/1986 | Sullivan | 116/173 |
| 5,343,825 | 9/1994 | Gazecimeon et al. | 116/173 |

*Primary Examiner*—Alexander Thomas
*Attorney, Agent, or Firm*—Richard L. Miller, P.E, Registered Patent Agent

[57] ABSTRACT

A device for attracting attention having an opened position and a closed position, and includes a pole and a flag extending from the pole. The pole has an extended position for holding in a hand and a retracted position for storage. The pole includes a plurality of tubular telescoping portions, a top cap that threadably engages the top of an upper portion of the plurality of tubular telescoping portions and which allows for selective closing of the upper portion when the pole is used to store valuables therein, and a bottom cap that threadably engages the bottom of a lower portion of the plurality of tubular telescoping portions and which allows for selective closing of the lower portion when the pole is used to store valuables therein. A substrate of the flag is elongated, and originates at the upper portion of the plurality of tubular telescoping portions and terminates in a pair of converging edges that join at a free convex tip. The flag is selectively maintained in the closed position by a portion of hook and loop fasteners that extends from the free convex tip of the substrate and mate with a mating portion of hook and loop fasteners that are appropriately positioned on the substrate. The substrate has "TAXI" indicia thereon for hailing a taxi.

12 Claims, 1 Drawing Sheet

FIG. 1
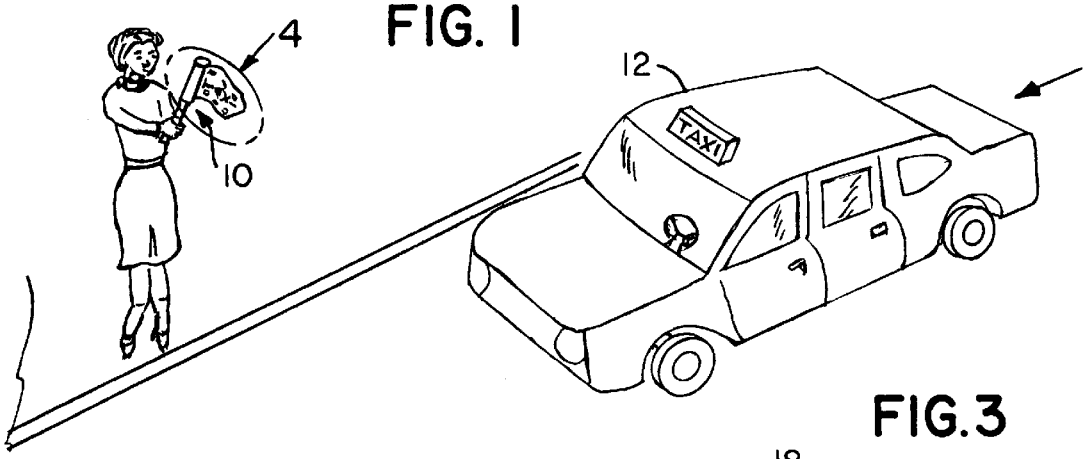
FIG.2
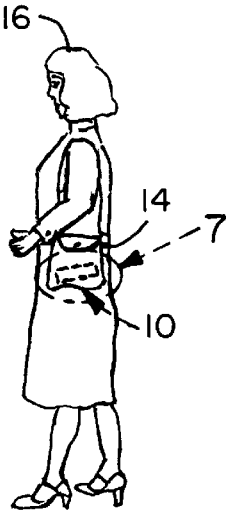
FIG.7
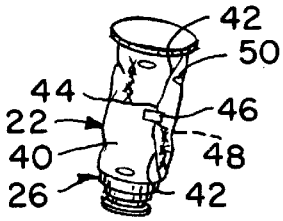
FIG.3
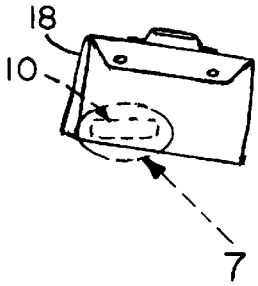
FIG.8
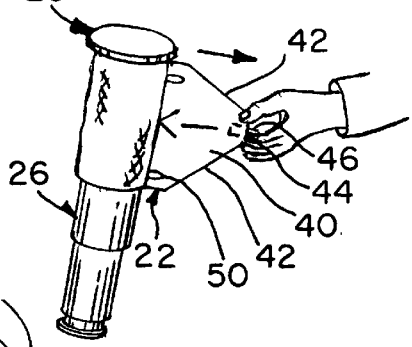
FIG.5
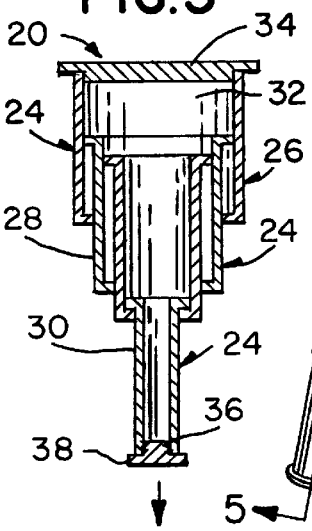
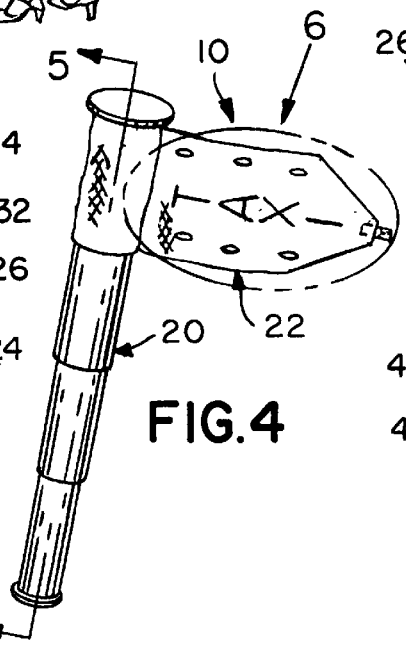
FIG.4
FIG.6
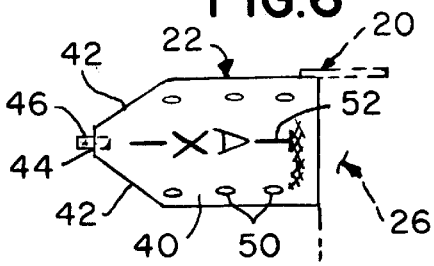

DEVICE FOR ATTRACTING ATTENTION—(TAXI HAILER)

BACKGROUND OF THE INVENTION

1. Field of the Invention

The present invention relates to a device for attracting attention. More particularly, the present invention relates to a taxi hailer.

2. Description of the Prior Art

Numerous innovations for devices for attracting attention have been provided in the prior art. Even though these innovations may be suitable for the specific individual purposes to which they address, however, they differ from the present invention. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a device for attracting attention that avoids the disadvantages of the prior art.

ANOTHER OBJECT of the present invention is to provide a device for attracting attention that is simple and inexpensive to manufacture.

STILL ANOTHER OBJECT of the present invention is to provide a device for attracting attention that is simple to use.

BRIEFLY STATED, YET ANOTHER OBJECT of the present invention is to provide a device for attracting attention having an opened position and a closed position, and includes a pole and a flag extending from the pole. The pole has an extended position for holding in a hand and a retracted position for storage. The pole includes a plurality of tubular telescoping portions, a top cap that threadably engages the top of an upper portion of the plurality of tubular telescoping portions and which allows for selective closing of the upper portion when the pole is used to store valuables therein, and a bottom cap that threadably engages the bottom of a lower portion of the plurality of tubular telescoping portions and which allows for selective closing of the lower portion when the pole is used to store valuables therein. A substrate of the flag is elongated, and originates at the upper portion of the plurality of tubular telescoping portions and terminates in a pair of converging edges that join at a free convex tip. The flag is selectively maintained in the closed position by a portion of hook and loop fasteners that extends from the free convex tip of the substrate and mate with a mating portion of hook and loop fasteners that are appropriately positioned on the substrate. The substrate has "TAXI" indicia thereon for hailing a taxi.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention in use hailing a taxi;

FIG. 2 is a diagrammatic perspective view of the present invention in the closed position and carried in a woman's pocket book;

FIG. 3 is a diagrammatic perspective view of the present invention in the closed position and carried in a brief case;

FIG. 4 is an enlarged diagrammatic perspective view of the area generally enclosed by the dotted ellipse identified by arrow 4 in FIG. 1 of the present invention;

FIG. 5 is an enlarged cross sectional view taken on line 5—5 in FIG. 4 of the pole of the present invention;

FIG. 6 is a diagrammatic side elevational view of the area generally enclosed by the dotted ellipse identified by arrow 6 in FIG. 4 of the flag of the present invention;

FIG. 7 is a diagrammatic perspective view of the present invention in the closed position; and FIG. 8 is a diagrammatic perspective view of the present invention achieving the opened position.

LIST OF REFERENCE NUMERALS UTILIZED IN THE DRAWING

10 device for attracting attention of the present invention
12 taxi
14 pocket book of women 16
16 women
18 brief case
20 pole
22 flag
24 plurality of tubular telescoping portions of pole 20
26 upper portion of plurality of tubular telescoping portions 24 of pole 20
28 intermediate portion of plurality of tubular telescoping portions 24 of pole 20
30 lower portion of plurality of tubular telescoping portions 24 of pole 20
32 top of upper portion 26 of plurality of tubular telescoping portions 24 of pole 20
34 top cap of pole 20
36 bottom of lower portion 30 of plurality of tubular telescoping portions 24 of pole 20
38 bottom cap of pole 20
40 substrate of flag 22
42 pair of converging edges of substrate 40 of flag 22
44 free convex tip of substrate 40 of flag 22
46 portion of hook and loop fasteners of flag 22
48 mating portion of hook and loop fasteners of flag 22
50 plurality of throughbores in substrate 40 of flag 22 for allowing wind to pass therethrough when flag 22 is in open position
52 indicia on substrate 40 of flag 22

DETAILED DESCRIPTION OF THE PREFERRED EMBODIMENT

Referring now to the figures, in which like numerals indicate like parts, and particularly to FIGS. 1–3, respectively, the device for attracting attention of the present invention is shown generally at 10 hailing a taxi 12, in the closed position and carried in a pocket book 14 of a women 16, and in the closed position and carried in a brief case 18.

The overall configuration of the device for attracting attention 10 can best be seen in FIG. 4, and as such, will be discussed with reference thereto.

The device for attracting attention 10 has an opened position and a closed position, and comprises a pole 20 and an optionally fluorescent flag 22 extending from the pole 20.

The specific configuration of the pole 20 can best be seen in FIG. 5, and as such, will be discussed with reference thereto.

The pole 20 has an extended position for holding in a hand and a retracted position for storage, and comprises a plurality of tubular telescoping portions 24.

The plurality of tubular telescoping portions 24 of the pole 22 comprises an upper portion 26, an intermediate portion 28 that is narrower than, and depends telescopically axially from, the upper portion 26 of the plurality of tubular telescoping portions 24 of the pole 20, and a lower portion 30 that is narrower than, and depends telescopically axially from, the intermediate portion 28 of the plurality of tubular telescoping portions 24 of the pole 20.

The upper portion 26 of the plurality of tubular telescoping portions 24 of the pole 20 has a top 32 that is open and internally threaded.

The pole 20 further comprises a top cap 34 that is flat and wider than, and threadably engages the internal threads in, the top 32 of the upper portion 26 of the plurality of tubular telescoping portions 24 of the pole 20, which allows for selective closing of the upper portion 26 of the plurality of tubular telescoping portions 24 of the pole 20 when the pole 26 is used to store valuables therein.

The lower portion 30 of the plurality of tubular telescoping portions 24 of the pole 20 has a bottom 36 that is open and internally threaded.

The pole 20 further comprises a bottom cap 38 that is flat and wider than, and threadably engages the internal threads, in the bottom 36 of the lower portion 30 of the plurality of tubular telescoping portions 24 of the pole 20, which allows for selective closing of the lower portion 30 of the plurality of tubular telescoping portions 24 of the pole 20 when the pole 26 is used to store valuables therein.

The specific configuration of the flag 22 can best be seen in FIGS. 6–8 and as such, will be discussed with reference thereto.

The flag 22 has an open position for attracting attention and a closed position in which it wraps around the upper portion 26 of the plurality of tubular telescoping portions 24 of the pole 20.

The flag 22 extends from the upper portion 26 of the plurality of tubular telescoping portions 24 of the pole 20, and comprises a substrate 40.

The substrate 40 of the flag 22 is elongated, and originates at the upper portion 26 of the plurality of tubular telescoping portions 24 of the pole 20, and terminates in a pair of converging edges 42 that join at a free convex tip 44.

The flag 22 is selectively maintained in the closed position by a portion of hook and loop fasteners 46 that extends from the free convex tip 44 of the substrate 40 of the flag 22 and mate with a mating portion of hook and loop fasteners 48 that are appropriately positioned on the substrate 40 of the flag 22.

The substrate 40 of the flag 22 has a plurality of throughbores 50 for allowing wind to pass therethrough when the flag 22 is in the open position.

The substrate 40 of the flag 22 further has indicia 52 thereon that extends axially from its origin to its termination. The indicia 52 on the substrate 40 of the flag 22 is preferably "TAXI" for hailing the taxi 12.

It will be understood that each of the elements described above, or two or more together, may also find a useful application in other types of constructions differing from the types described above.

While the invention has been illustrated and described as embodied in a device for attracting attention, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for attracting attention having an opened position and a closed position, comprising:

a) a pole; and b) a flag extending from said pole, wherein said pole has an extended position for holding in a hand and a retracted position for storage, and comprises a plurality of tubular telescoping portions, wherein said plurality of tubular telescoping portions of said pole comprises:

i) an upper portion;

ii) an intermediate portion that is narrower than, and depends telescopically axially from, said upper portion of said plurality of tubular telescoping portions of said pole; and iii) a lower portion that is narrower than, and depends telescopically axially from, said intermediate portion of said plurality of tubular telescoping portions of said pole, wherein said lower portion of said plurality of tubular telescoping portions of said pole has a bottom that is open and internally threaded, wherein said pole further comprises a bottom cap that is flat and wider than, and threadably engages said internal threads in, said bottom of said lower portion of said plurality of tubular telescoping portions of said pole, which allows for selective closing of said lower portion of said plurality of tubular telescoping portions of said pole when said pole is used to store valuables therein.

2. The device as defined in claim 1, wherein said upper portion of said plurality of tubular telescoping portions of said pole has a top that is open and internally threaded.

3. The device as defined in claim 1, wherein said pole further comprises a top cap that is flat and wider than, and threadably engages said internal threads in, said top of said upper portion of said plurality of tubular telescoping portions of said pole, which allows for selective closing of said upper portion of said plurality of tubular telescoping portions of said pole when said pole is used to store valuables therein.

4. The device as defined in claim 1, wherein said flag has an open position for attracting attention and a closed position in which it wraps around said upper portion of said plurality of tubular telescoping portions of said pole.

5. The device as defined in claim 4, wherein said flag extends from said upper portion of said plurality of tubular telescoping portions of said pole, and comprises a substrate.

6. The device as defined in claim 5, wherein said substrate of said flag is elongated, and originates at said upper portion of said plurality of tubular telescoping portions of said pole, and terminates in a pair of converging edges that join at a free convex tip.

7. The device as defined in claim 6, wherein said flag is selectively maintained in said closed position by a portion of hook and loop fasteners that extends from said free convex tip of said substrate of said flag and mate with a mating portion of hook and loop fasteners that are appropriately positioned on said substrate of said flag.

8. The device as defined in claim 5, wherein said substrate of said flag has a plurality of throughbores for allowing wind to pass therethrough when said flag is in said open position.

9. The device as defined in claim 5, wherein said substrate of said flag has indicia thereon that extends axially from its origin to its termination.

10. The device as defined in claim 9, wherein said indicia on said substrate of said flag is "TAXI" for hailing a taxi.

11. The device as defined in claim 9, wherein said indicia on said substrate of said flag is fluorescent.

12. The device as defined in claim 5, wherein said substrate of said flag is fluorescent.

* * * * *